US006045751A

United States Patent [19]

Buschow et al.

[11] Patent Number: 6,045,751

[45] Date of Patent: Apr. 4, 2000

[54] METHOD OF MANUFACTURING A PERMANENT MAGNET ON THE BASIS OF NDFEB

[76] Inventors: Kurt H. J. Buschow; Franciscus H. Feijen; Dirk B. De Mooij; Arjan Noordermeer, all of Groenewoudseweg 1, Eindhoven, Netherlands

[21] Appl. No.: 08/105,820

[22] Filed: Aug. 11, 1993

[30] Foreign Application Priority Data

Aug. 13, 1992 [EP] European Pat. Off. ..... 92202498

[51] Int. Cl.[7] ..... B22F 3/12

[52] U.S. Cl. ..... 419/23; 419/38; 419/32; 419/57

[58] Field of Search ..... 419/2, 10, 23, 419/32, 38, 44, 57; 75/225, 244, 252; 148/102, 103, 302; 252/62.54

[56] References Cited

U.S. PATENT DOCUMENTS

| | | | |
|---|---|---|---|
| 4,710,431 | 12/1987 | Van Engelen et al. | 428/457 |
| 4,747,874 | 5/1988 | Ghandehari | 75/225 |
| 4,762,574 | 8/1988 | Ghandehari | 148/103 |
| 4,897,130 | 1/1990 | Buschow | 148/302 |
| 4,931,092 | 6/1990 | Cisar et al. | 75/244 |
| 4,935,074 | 6/1990 | De Mooij et al. | 148/302 |
| 5,004,499 | 4/1991 | Ghandehari | 75/254 |
| 5,057,165 | 10/1991 | Nagata et al. | 148/102 |
| 5,240,627 | 8/1993 | Mohri et al. | 252/62.54 |
| 5,279,785 | 1/1994 | Mohri et al. | 419/2 |

FOREIGN PATENT DOCUMENTS 0249973 12/1987 European Pat. Off. .

*Primary Examiner*—Daniel J. Jenkins

[57] ABSTRACT

A description is given of a method of manufacturing a permanent magnet on the basis of NdFeB. In this method a powder of NdFeB and a powder of a Ga alloy, consisting mainly of Ga and one or more than one rare earth metals (RE), is mixed to form a mixture which is subsequently aligned, compressed and sintered. Such alloys can be ground into homogeneous, fine-grain powders in a simple manner. The composition of the alloy preferably corresponds to the formula $REGa_x$, where x=1 or x=2. Alloys which are very suitable contain Dy and/or Tb as the rare earth metal.

6 Claims, 1 Drawing Sheet

METHOD OF MANUFACTURING A PERMANENT MAGNET ON THE BASIS OF NDFEB

Figure 1:
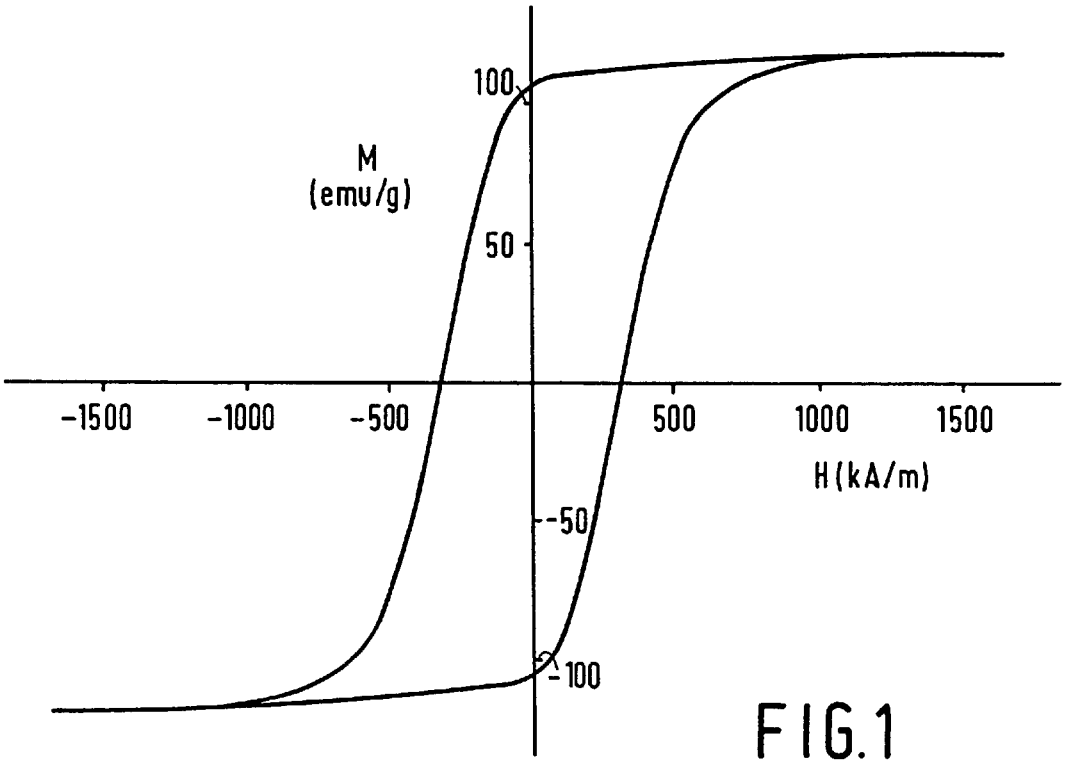

The invention relates to a method of manufacturing a permanent magnet on the basis of NdFeB, in which method a powder of NdFeB and a powder of metallic Ga are mixed to form a mixture which is subsequently aligned and compressed into a shaped article which is then sintered. Magnets on the basis of NdFeB have extremely favourable hard-magnetic properties, such as a large energy product and a relatively high saturation magnetization. Said magnets are used, in particular, in applications requiring miniaturization of hard-magnetic components, as is the case with, for example, small electric motors for driving hard discs in computers.

A permanent magnet on the basis of NdFeB is to be understood to mean herein a magnet whose magnetic phase consists of an intermetallic compound having a tetragonal crystal structure and a composition in accordance with the formula $Nd_2Fe_{14}B$. In such a magnet a substantial part of the Nd of the intermetallic compound can be substituted by one or more than one other rare earth metals, such as Pr and Dy. Also an important part of the Fe may be substituted by one or more than one other transition metals, such as Co. The magnetic phase of such a magnet comprises 30–38 wt. % of rare earth metal, 0.8–1.3 wt. % of B and 60–80 wt. % of transition metal.

A method of the type mentioned in the opening paragraph is described in, for example, European Patent Application EP-A 249.973. In the known method a powder of an intermetallic alloy of composition $Nd_{13}Fe_{81}B_6$ is mixed with a powder of metallic Ga in a ball mill. The mixture thus obtained comprises 96 wt. % of NdFeB powder having an average particle size of 3 micrometers and 4 wt. % of metallic Ga powder having an average particle size of a few tens of micrometers. The mixture is subsequently aligned in a magnetic field, compressed under increased pressure at 600° C. and sintered. This method causes Ga to melt and subsequently form a so-called cementing phase which is present between the magnetic grains of the NdFeB. The presence of said Ga-containing phase around the NdFeB grains provides the magnet with an improved corrosion resistance and an increased coercive force.

The known method has disadvantages. For example, metallic Ga is very ductile by nature. Owing thereto it proved to be very difficult to convert metallic Ga into homogenic powders. This applies in particular to Ga powders having an average grain size below 100 micrometers. Ga powders having an average grain size below 10 micrometers cannot be produced in practice. It has been found that mixing such Ga powders and NdFeB powders to a homogeneous mixture is a very problematic process. If said powders are inhomogeneously mixed, the magnetic properties of the permanent magnets are adversely affected.

It is an object of the invention to provide, inter alia, a method in which the above problem is overcome. The invention further aims at providing a method of manufacturing permanent magnets having a relatively satisfactory corrosion resistance and a relatively large coercive force. The magnets manufactured in accordance with the inventive method must also exhibit a sufficiently high Curie temperature.

These and other objects are achieved by a method as described in the opening paragraph, which is characterized according to the invention in that instead of a powder of metallic Ga a powder of a Ga alloy is used which consists predominantly of Ga and one or more than one rare earth metals (RE). It has been found that alloys of Ga and one or more than one rare earth metals are very brittle. By virtue thereof they can be pulverized relatively easily into powders having a relatively small average grain size. Homogenic powders having an average grain size of 10 micrometers and less can be manufactured in a relatively simple manner from RE-Ga alloys. In this respect, alloys of NdGa and NdPrGa were found to be suitable.

It is assumed that, during sintering, the Ga of the alloy can make a bond with the free Nd, which is present in relatively large quantities in the liquid phase, to form an alloy which is not sensitive to oxidation. Further it has been found that, during sintering, an exchange of Ga for Fe, which is bonded in the hard-magnetic phase of the grains, can take place. Said exchange, which occurs in the outermost part of the grains, provides the hard-magnetic material with an increased Curie temperature.

In this connection, it is noted that it is known per se that the element Al also has an oxidation-inhibiting effect when it is sintered in powder form along with an NdFeB powder. However, in this case a decrease of the Curie temperature takes place. It is assumed that this is caused by the exchange of the intermetallically bonded Fe of the hard-magnetic phase for Al of the liquid phase between the grain boundaries. It is known that the Curie temperature of magnets on the basis of NdFeB is relatively low already. Therefore, a further decrease of the Curie temperature is considered to be very disadvantageous.

Besides Ga and RE the alloys used in the method in accordance with the invention may additionally comprise a limited quantity of other elements. The quantity of other elements may not exceed 20 wt. %. The presence of larger quantities of other elements may cause the brittleness of the alloy to be insufficient. In this connection it is noted that apart from the RE alloys comprising Ga, substantially all Ga alloys are insufficiently brittle and, hence, are hard to pulverize into homogeneous powders having a small grain size. Therefore, the alloys preferably consist only of Ga and RE.

A preferred embodiment of the method in accordance with the invention is characterized in that the composition of the alloy corresponds to the formula $REGa_x$, where x=1 or x=2. It has been found that alloys of the type $REGa_2$ and of the type REGa are more brittle than alloys having a different ratio between RE and Ga. This can probably be attributed to the fact that in the two above alloys RE and Ga form compounds having a fixed stoichiometry. $REGa_2$ is preferred to REGa because it has a relatively high Ga content. This has the advantage that this composition enables relatively much metallic Nd from the liquid phase to be bonded.

A further preferred embodiment of the method in accordance with the invention is characterized in that the rare earth metals used are Tb and/or Dy. Alloys of these elements with Ga do not only provide the magnets with an increased Curie temperature and an improved resistance to corrosion but also with an increased anisotropy. This can probably be attributed to an exchange of Nd for Tb and/or Dy in the outermost part of the magnetic grains. The Nd thus released in the liquid phase is bonded by the Ga present to form an alloy which is not sensitive to oxidation.

A further favourable embodiment of the method in accordance with the invention is characterized in that the average particle size of the powder of the Ga alloy is smaller than the average particle size of the powder of NdFeB. Experiments have shown that this measure enables improved and quicker blending of both powders into a homogeneous mixture. Preferably, the average particle size of the powder of the Ga alloy ranges from 2–10 micrometers and the average particle size of the NdFeB powder ranges from 10–100 micrometers.

In a further advantageous embodiment of the inventive method the mixture contains 1–5 wt. % of the powder of the Ga alloy. It has been found that the addition of less than 1 wt. % of Ga powder to the mixture results in an insufficient increase of the resistance to corrosion. The addition of more than 5 wt. % of Ga powder to the mixture results in a degree of magnetic dilution which is too high. An optimum combination of these properties is attained when the quantity of the Ga-alloy powder added ranges from 2–4 wt. %.

Figure 2:
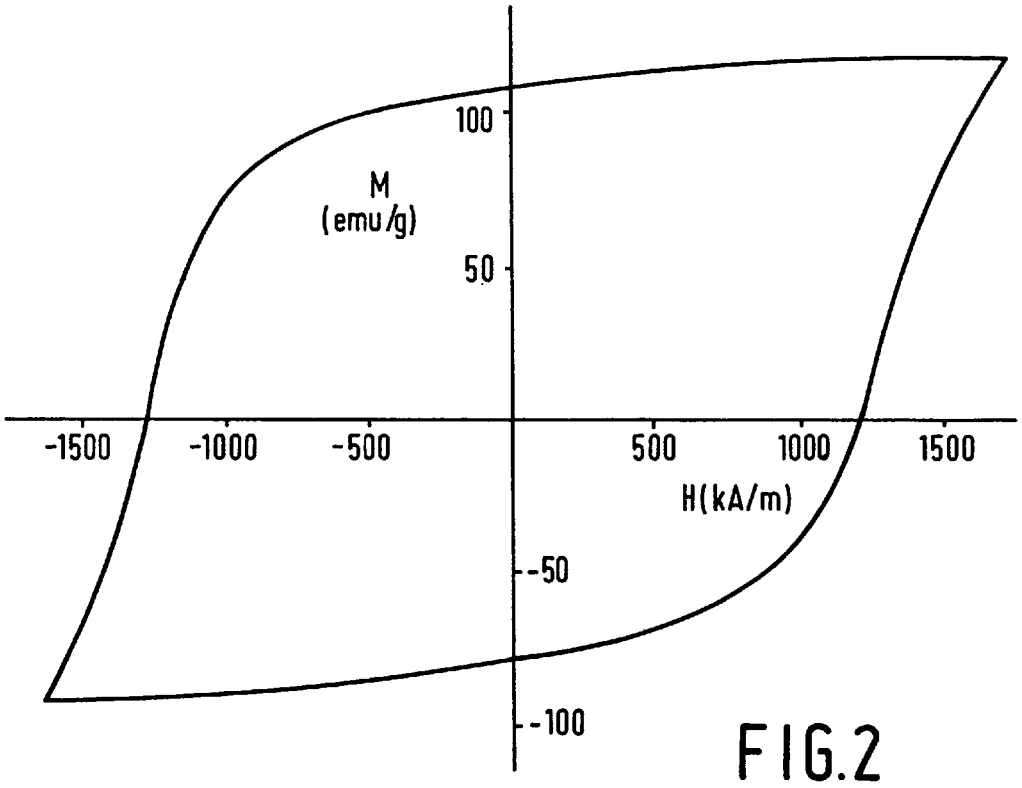

The invention will be explained in greater detail by means of exemplary embodiments and with reference to the accompanying drawing, in which FIG. 1 shows a magnetization curve of a magnet manufactured in accordance with the method of the invention, FIG. 2 shows a different magnetization curve of a magnet manufactured in accordance with the inventive method.

EXEMPLARY EMBODIMENT 1

An alloy having the composition $Nd_{15.5}Fe_{72}B_7$ was prepared from said elements by means of arc melting under an inert atmosphere. The alloy was ground successively in a ball mill and a jet mill under a protective gas until a powder having an average particle size of 20 micrometers was obtained. An alloy having the composition $Dy_{33}Ga_{67}$ was also prepared from said elements by means of arc melting. The melting temperature of this alloy is 1330° C. The alloy was subsequently ground to a powder having an average particle size of 5 micrometers. These powders were used to prepare a mixture comprising 3 wt. % of $DyGa_2$ powder and 97 wt. % of NdFeB powder. The mixture was oriented in a magnetic field and compressed. The shaped article thus formed was sintered in the absence of oxygen for 1 hour at 1085° C.

FIG. 1 shows the magnetization curve measured after cooling of the sintered magnet. Said magnet exhibited a magnetization of 118 $Am^2/kg$ and a coercive force of 300 kA/m. The Curie temperature of the magnet was 322° C. This is seven degrees higher than the Curie temperature of a magnet to which no DyGa powder was added. Accelerated life tests showed that the magnet had a better resistance to oxidation than a conventional NdFeB magnet.

EXEMPLARY EMBODIMENT 2

A powder having an average particle size of 10 micrometers, formed from the above-mentioned NdFeB alloy was mixed in the same manner with a DyGa powder having an average particle size of 5 micrometers. The quantity of GaDy powder being 3 wt. % of the overall mixture. This mixture was subsequently oriented, compressed and sintered (1 hour, 1048° C.). After sintering the magnet was subjected to a temperature treatment at 580° C. under a protective gas for 90 minutes.

FIG. 2 shows the magnetization curve of the magnet described in the preceding paragraph. The magnetization was 117 $kA^2/kg$ and the coercive force was 1300 kA/m. The Curie temperature was 322° C. Also this magnet was found to be less sensitive to oxidation than conventional NdFeB magnets which do not comprise Ga in the intergranular phase.

The microstructure of a number of the magnets thus manufactured was examined by means of a transmission electron microscope (TEM) which was provided with an electron-probe microanalyser (EPMA). These examinations showed that there was no Nd-rich eutectic left between the grains of the main phase. Instead, the grains were separated by a phase consisting mainly of Nd (approximately 60% by volume) and Ga (approximately 40% by volume). Most of the Dy ended up in the main phase (grains). This can probably be attributed to grain growth of the main phase during the sintering process. It was also found that the main phase had taken up a small quantity of Ga which was present mainly in the outermost shell of the grains.

We claim:

1. A method of manufacturing a permanent magnet comprising NdFeB, said method comprising forming a mixture of a powder of NdFeB and a powder of an alloy consisting in an amount of at least 50% of Ga and at least one rare earth metal in an amount not greater than 50%; magnetically orienting said mixture; compressing said thus oriented mixture and sintering the resultant compressed mixture in an oxygen-free atmosphere.

2. A method of claim 1 characterized in that the alloy is of the formula $REGa_x$ where RE is at least one rare earth metal and x=1 or 2.

3. A method of claim 1 characterized in that the rare earth metal is selected from the group consisting of Dy and Tb.

4. A method of claim 1 characterized in that the mixture contains 2–4 wt. % of the powder of the Ga alloy.

5. A method as claimed in claim 1, characterized in that the average particle size of the powder of the Ga alloy in the mixture is smaller than the average particle size of the powder of NdFeB.

6. A method as claimed in claim 1, characterized in that the mixture contains 1–5 wt. %, of the powder of the Ga alloy.

* * * * *